United States Patent [19]

Obrist et al.

[11] 4,171,749

[45] Oct. 23, 1979

[54] POURER CLOSURE

[75] Inventors: Albert Obrist; Dietmar Aichinger, both of Reinach, Switzerland

[73] Assignee: Albert Obrist AG., Reinach, Switzerland

[21] Appl. No.: 915,599

[22] Filed: Jun. 15, 1978

[30] Foreign Application Priority Data

Jun. 17, 1977 [CH] Switzerland ..... 7448/77

[51] Int. Cl.[2] ..... B65D 41/48

[52] U.S. Cl. ..... 215/256; 215/295; 215/318; 215/307; 222/541; 222/546

[58] Field of Search ..... 215/253, 256, 295, 307, 215/318; 222/541, 546, 562

[56] References Cited

U.S. PATENT DOCUMENTS

| | | | |
|---|---|---|---|
| 3,099,361 | 7/1963 | Ruetz | 215/295 X |
| 3,341,046 | 9/1967 | Bereziat | 215/253 X |
| 3,910,444 | 10/1975 | Foster | 215/295 |

FOREIGN PATENT DOCUMENTS

| | | | |
|---|---|---|---|
| 384389 | 2/1965 | Switzerland | 215/318 |

*Primary Examiner*—Donald F. Norton
*Attorney, Agent, or Firm*—Larson, Taylor and Hinds

[57] ABSTRACT

A two piece pourer closure, comprising a base portion with a cover portion which on rotation is raised by cooperating protuberances to open a pouring aperture, is provided with a separable guarantee strip, at least partly covering the cover portion to prevent it from being grasped and rotated and with means for centering and supporting a jacket portion of the cover against laterally acting forces. The means for supporting the jacket portion may be the protuberances on the base portion or a ring of guide elements on the base portion engaging the inner surface of the jacket portion.

8 Claims, 5 Drawing Figures

POURER CLOSURE

FIELD OF THE INVENTION

This invention is concerned with a two-piece pourer closure for a container comprising a base portion of elastic material to fit onto the container aperture and leave free a throughflow aperture, and a cover portion which closes the base portion, said base portion having a foot portion which is capable of being linked to the container aperture, a substantially cylindrical pouring cylinder surrounding the throughflow aperture, and a circular annular edge portion surrounding the lower end of the pouring cylinder, said cover portion having a sealing portion which projects from the bottom of the cover and which cooperates with the pouring cylinder, and an external jacket portion concentrically surrounding the pouring cylinder with an intermediate space therebetween, at least two cooperating run-up protuberances in the said intermediate space, at least one of which has a sloping plane surface, one protuberance being arranged on the base portion and one on the cover portion, whereby that cover portion on rotation in relation to the foot portion is lifted by the run-up protuberances and the closure can be opened.

RELEVANT PRIOR ART

The most relevant prior art known to the applicant is contained in Swiss Patent Specification No. 384,389 (Ruetz) of Feb. 15, 1965, and German Patent Specification No. 1,536,256 (Astra) of Feb. 18, 1971.

BACKGROUND OF THE INVENTION

A disadvantage of known closures is that the cover portion must be made of relatively hard, and usually also brittle, synthetic material, since grasping and rotating the cover portion in the region of the jacket leads to lateral compression of the jacket portion. Deformation of the jacket portion must be avoided in view of the functional capacity of the run-up protuberances. In addition, the fact that the foot portion must be elastic with a view to subsequently fitting the closure to a container, means that the cylindrical pouring portion is also elastic and accordingly is not capable of holding the cover portion securely in position. This involves considerable difficulties if the cover portion is intended to be linked to the foot portion by a guarantee ring, since the guarantee ring may be damaged if the two parts undergo mutual lateral displacement.

The present invention has for an object to avoid the disadvantages of known closures, and in particular to provide a pourer closure which can be rationally produced and which may be provided with a damage-proof guarantee ring.

SUMMARY OF THE INVENTION

According to the invention, this object is achieved in that the foot portion comprises a guarantee ring projecting upwards and at least partly covering the jacket portion to prevent the cover portion from being grasped and rotated, said guarantee ring being separably joined to the foot portion in the region of the circular annular edge portion by an intended tearing line comprising weakened places in the material, and a fitment on the base portion centering and supporting the jacket portion against laterally acting forces.

As will be seen, this ensures in optimally simple fashion that the cover portion is surrounded by an elastic guarantee band in such a manner that it cannot be rotated and thus opened without the guarantee band being damaged, and that any damage to the intended tearing line which might occur during transport or when placing the cover portion in position is prevented by the fitment for centering and supporting the jacket portion against laterally acting forces. It also enables elastic synthetic substances to be used for producing the cover portion.

The invention may be executed in an especially simple fashion if the run-up protuberances themselves serve as the fitment for providing lateral support. The run-up protuberances project relatively high in the intermediate space between the jacket portion and the pouring cylinder, and thus ensure that the cover portion is securely stabilised laterally. In order to simplify the operation of placing in position, the run-up protuberances may furthermore be made so as to taper upwardly, so that compensation is provided for any misalignment of the cover portion when it is being placed in position.

According to the material used and the intended use in any particular case, the run-up protuberances may either be arranged at a certain minimum clearance from the inside wall of the jacket portion or may indeed touch the latter.

Guide elements which support the lower edge of the jacket portion may also be used for the purpose of laterally supporting the cover portion. These elements may be provided either alone or in addition to the run-up protuberances. It is especially advantageous if such guide elements are made in the form of a continuous guide ring or of annular segments.

The cover portion may be firmly fixed to the foot portion by providing the jacket portion at its lower outside edge with tooth-like projections which engage in the weakened and/or penetration points of the intended tearing line of the guarantee ring. In this way, the cover portion is, by virtue of its shape, held fast on the foot portion until the guarantee ring is separated from the foot portion for the first time.

As will be seen, the invention yields not only the possibility of using softer and, if appropriate, also cheaper and better suited materials for the cover portion, but furthermore also ensures that the closure will carry out its function of providing a secure guarantee. In this connection, the detail design of the individual elements may naturally be modified by the technician without as a result departing from the basic idea of the invention. Thus for example the guide elements may take the form of naps or other raised portions or even depressions on the base portion. It is also possible to provide any desired number of run-up protuberances, corresponding to the purpose of use.

As will be seen, the inventive content and technical progress of the subject of the application are ensured both by the new individual features and more particularly by combining and sub-combining all the features which are used.

DESCRIPTION OF PREFERRED EMBODIMENTS

Figure 1:
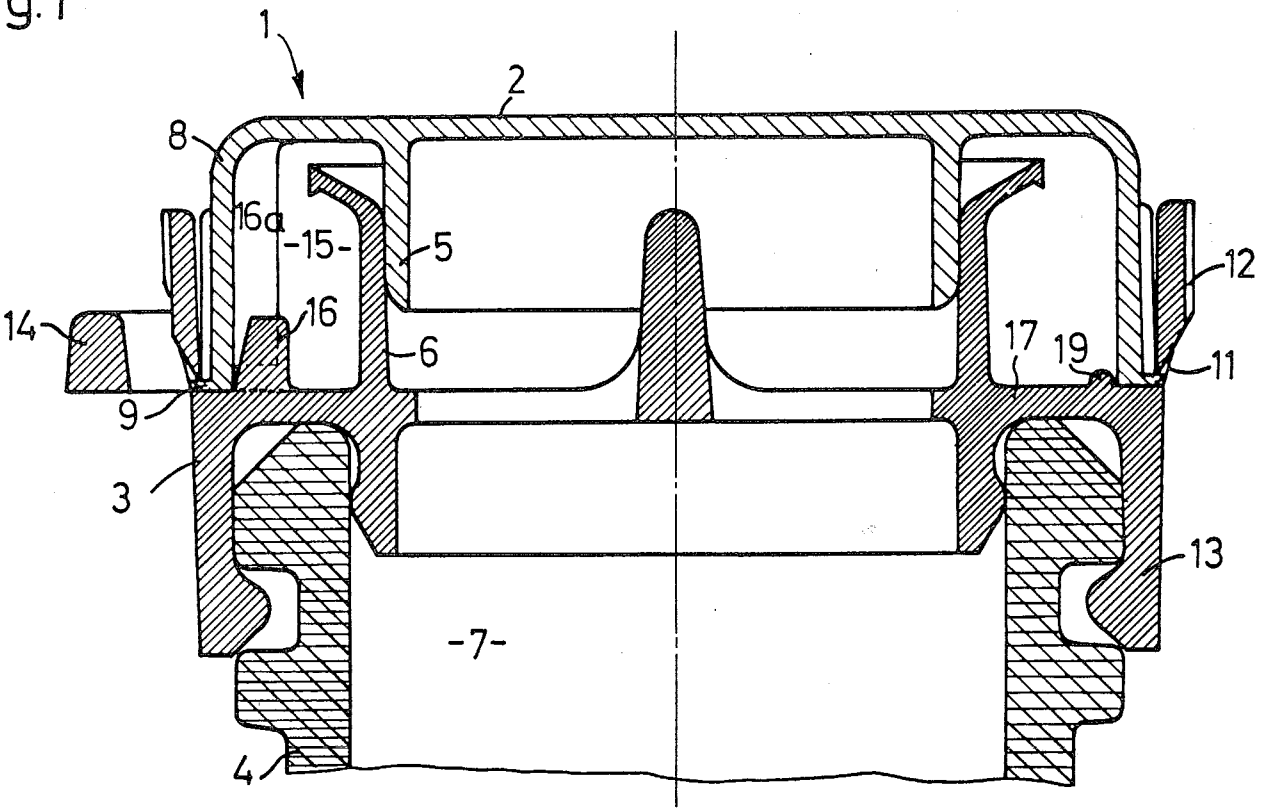
FIG. 1 is a cross-section of a pourer closure according to the invention.

As shown in FIG. 1, a pourer closure 1 comprises a cover portion 2 and a base portion 3 having a depending foot portion 13. The base portion 3 is mounted on the neck of a container 4 and secured thereon by virtue of its shape and is joined in fluid-tight fashion to the container neck. The cover portion 2 is mounted on the base portion 3, a cylindrical portion 5 thereof projecting into a pouring cylinder 6 formed on the base portion 3 and bearing in fluid-tight fashion against the latter in such a manner that the aperture 7 of the container 4 is closed. The cover portion 2 is also provided with a jacket portion 8 having at its lower end tooth-like projections 9 extending outwardly and projecting into perforations in an intended tearing line 11 which links a guarantee ring 12 to the base 3 or a foot portion 13 thereof. As will be seen, this holds the cover portion 2 fast to the base portion 3 as long as the guarantee ring 12 is not separated from the base portion 3 by tearing it away by means of a grip-flap 14. The projections 9 are bevelled on their underside so that it is readily possible, when assembling the cover portion 2 and the base portion 3, simply to push these portions into one another until the projections 9 snap into the perforations in the intended tearing line 11. The guarantee ring 12 readily yields during this pushing together, since the base portion 3 and the cover portion 2 are made of the same elastic material (polyethylene).

Figure 2:
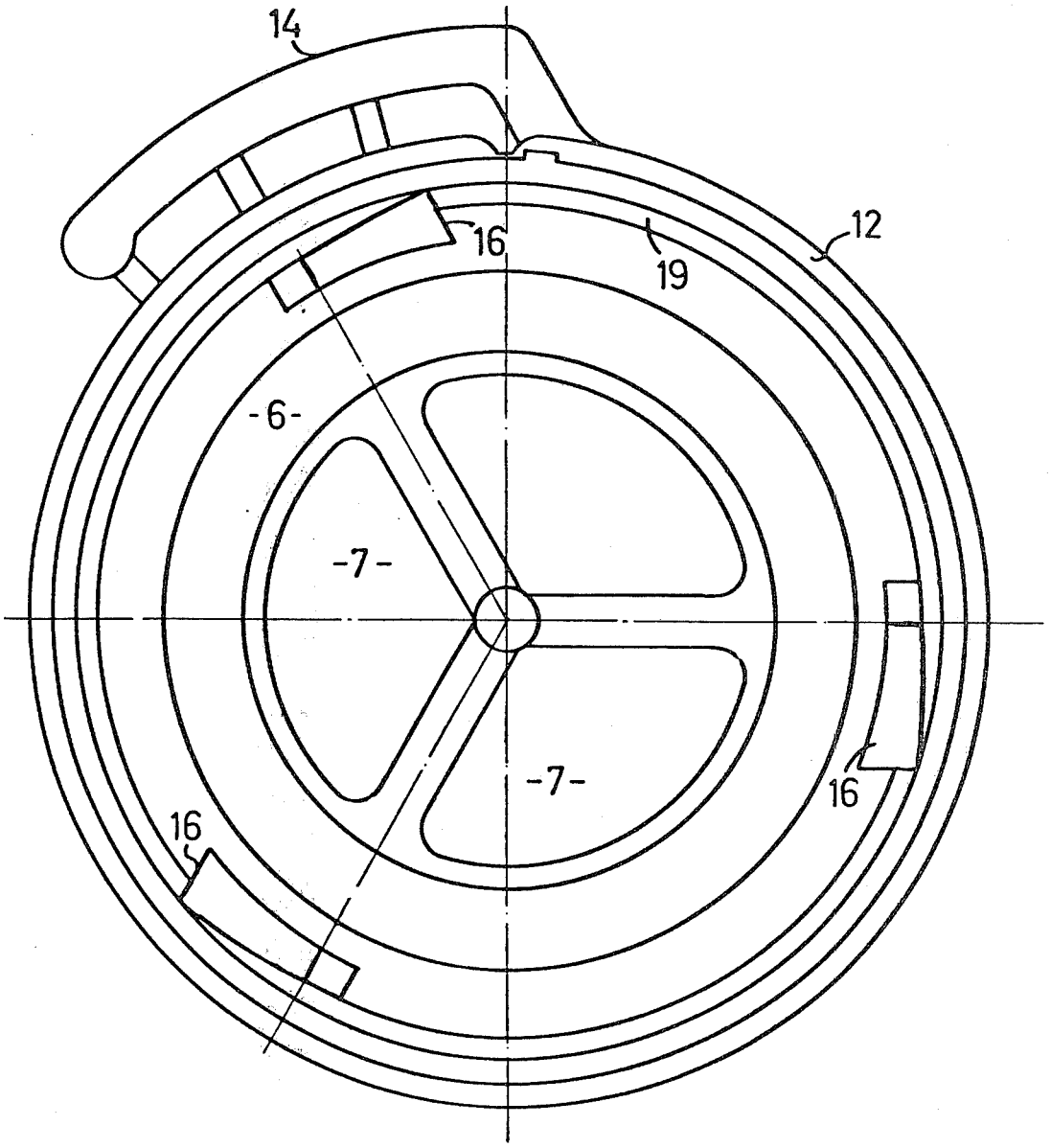
FIG. 2 is a plan view of the base portion according to FIG. 1.

As will be seen from FIG. 1 and FIG. 2, three run-up protuberances 16 forming ramps provided on the base 3 in a circle extend concentric with the container aperture 7 in the intermediate space 15 between the jacket portion 8 and the pouring cylinder 6. As will be seen from FIG. 3, the run-up protuberances 16 are arranged on a circular annular edge portion 17 which upwardly terminates the foot portion 13. On the inside of the jacket portion 8, there is a complementary run-up protuberance 16*a* which engages the run-up protuberance 16 when the cover portion 2 is rotated anti-clockwise, and upon further rotation runs up the sloping face 18 of the run-up protuberance 16 (FIG. 3), with the result that the cover portion 2 is lifted and separated from the base portion 3. As will be seen from FIG. 1, the run-up protuberance 16 is slightly bevelled on its side disposed towards the jacket portion 8, so that when the cover portion 2 is placed in position any errors in alignment which there may be between the two portions 2 and 3 are corrected, and the jacket portion 8 is guided into the gap between the run-up protuberance 16 and the guarantee ring 12. In addition, the jacket portion 8 is reliably secured by the run-up protuberances 16 against being forced or displaced inwards, for example when being tightened up or during transport, since said protuberances support the internal wall of the jacket portion 8 in the lower region thereof. This makes it possible for the cover portion 2 also to be injection-moulded from elastic synthetic material.

The closure will function satisfactorily and without impairment by any deformation which the jacket portion 8 may undergo even if especially elastic material is used.

The whole cover portion 2 is also prevented from being laterally displaced, for example by lateral pressure on the jacket portion 8, which might result in the intended tearing line 11 of the guarantee ring 12 being damaged.

It will furthermore be seen from FIGS. 1 and 2 that in addition to the supporting action of the edge portion the jacket portion 8 is protected from lateral displacement by a guide ring 19 on the circular annular edge portion 17. The guide ring 19 is arranged substantially concentrically with the circular ring of run-up protubarances 16, and supports by its external edge the lower inner edge of the jacket portion 8. It is clearly possible in some cases to make the guide ring 19 higher, or to replace the guide ring 19 by a simple depression in the base portion 3, which depression would then take over the function of supporting the jacket portion 8 against inward deformation. It would also for example be possible to provide more than three run-up protuberances 16 or to place the run-up protuberances 16 further inwards or in general to place them elsewhere, and merely to ensure that the lower end of the jacket portion 8 is supported by the guide ring 19. Nevertheless, as will be seen, the form of embodiment illustrated represents a solution which is to a large extent optimal to the problem pursued with the invention.

Figure 3:
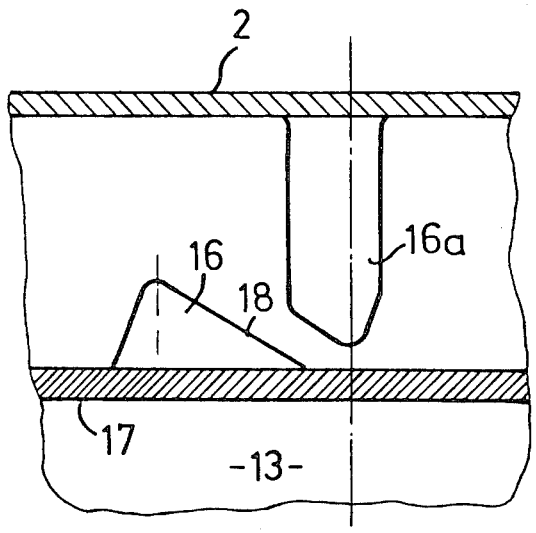
FIG. 3 is a side view of the run-up protuberances of FIG. 1.
Figure 4:
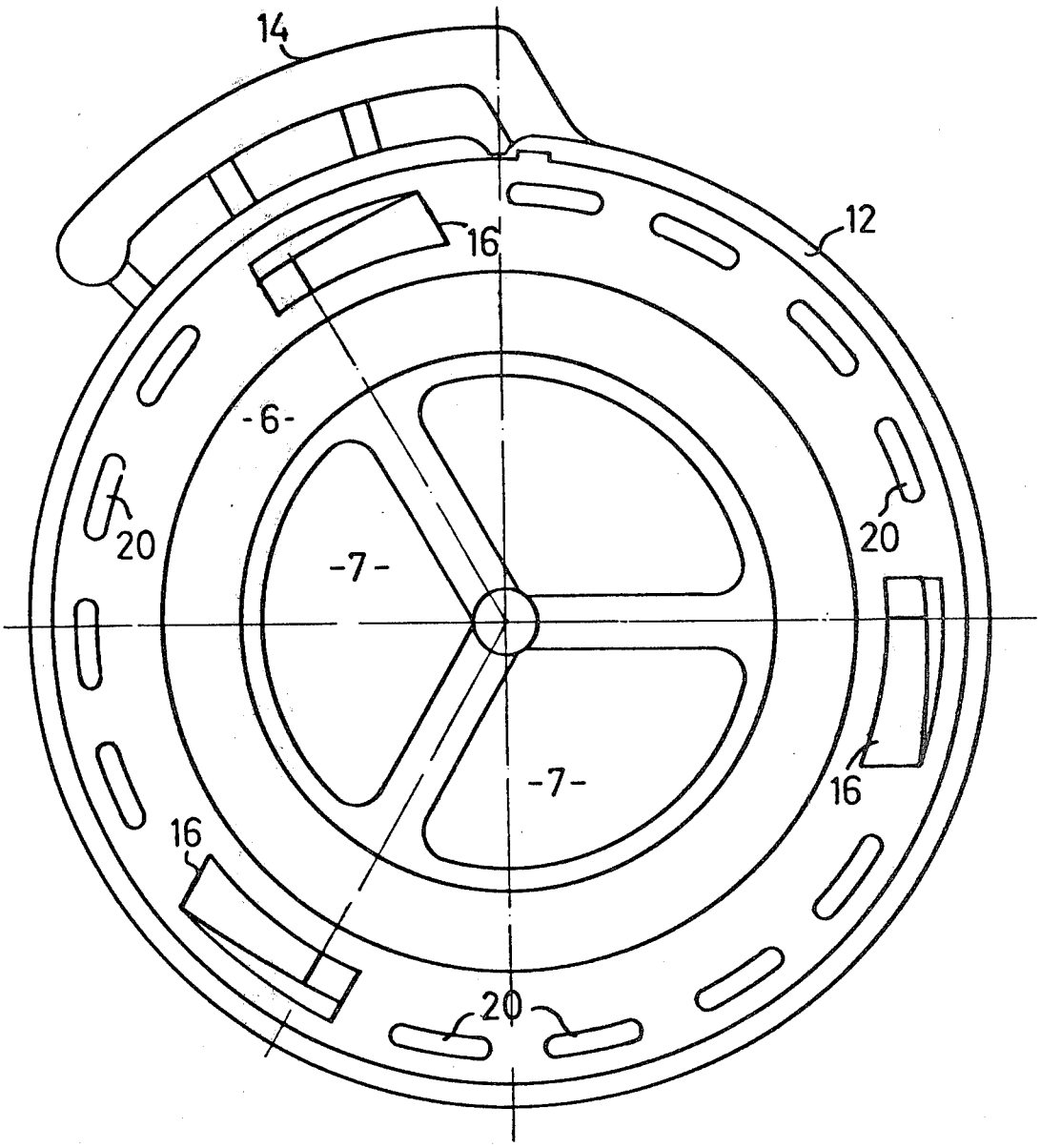
FIG. 4 is a plan view of a modified base portion.

FIG. 4 shows a plan view of a base portion 8, corresponding generally to the plan view according to FIG. 3. However, instead of a continuous guide ring, individual guide elements 20 are provided for the purpose of supporting the jacket portion 8 on the circular annular edge portion 17. The guide elements 20 are arranged on a circle which is concentric with the container aperture 7 in the same manner as the guide ring 19, and which corresponds substantially in internal diameter to the jacket portion 8. This arrangement enables a saving to be made in synthetic material without the function of the arrangement being impaired.

As will be seen, however, other forms of embodiment may be made without departing from the scope of the invention.

The chosen configuration of the invention furthermore leads quite generally to the smallest possible consumption of material and thus to great economy. This is more particularly true in comparison with other closure caps which are drawn downwards on the foot portion after the manner of a skirt, and are equipped in this lower region with a guarantee device. The invention accordingly not only concentrates on an especially advantageous structural and useful design, but furthermore aims in the specific configuration at economic formation. Arranging the guide elements in a region of the jacket portion which is complementary unsupported in the case of traditional cap closures, and more particularly using relatively high run-up protuberances, results in optimal support being provided for the jacket portion against laterally acting forces and pressures, for example upon opening.

Both the run-up protuberances and the guide elements may be arranged with a clearance from the internal wall of the jacket portion dependent on the material and the detailed construction, if this is possible and reliable, with a view to simplifying the operation of placing in position.

Figure 5:
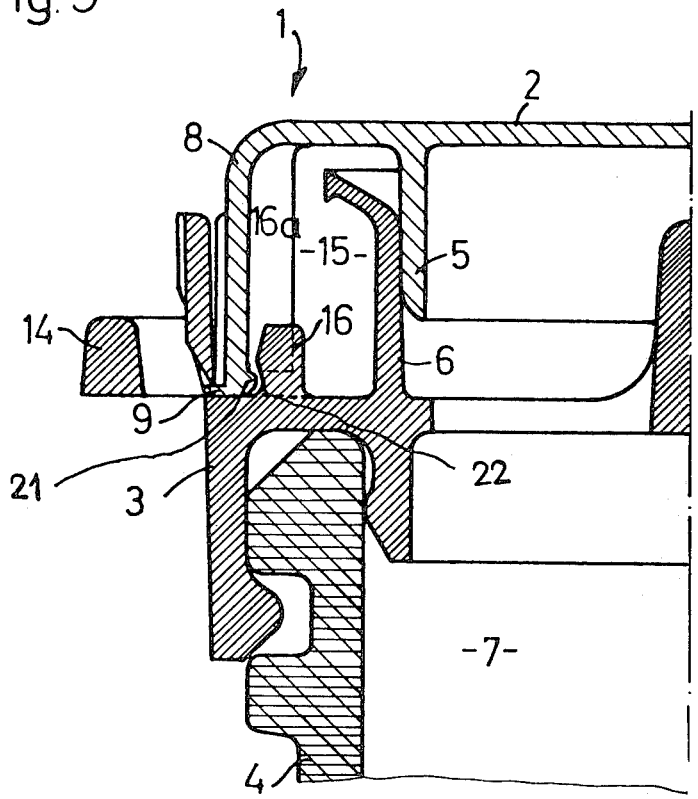
FIG. 5 is a cross-section of a pourer closure according to the invention with an additional retainer fitment.

FIG. 5 shows an embodiment in which a beading 21 and a depression 22 are provided on the jacket portion 8 and on the run-up protuberance 16 respectively. Because of the elastic tension of the jacket portion 8 and the elasticity of the material of the run-up protuberance 16, the beading 21 and the depression 22 can snap into one another with a shaped and forced locking action upon the pourer closure being closed, so that the cover portion 2 is retained on the base portion 3.

This arrangement ensures that even after the guarantee ring 12 has been removed the container 4 remains reliably closed. The arrangement of the beading 21 and the depression 22 on the jacket portion 8 and on the run-up protuberance 16 respectively ensures that the retaining means will function optimally without any need for additional retainer elements. Another thing which is avoided is the occurrence of irregularities in the wall of the pourer itself as a result, for example, of retaining means on the pouring cylinder 6 and on the sealing portion 5, in which irregularities the medium in the container 4 might be retained, thus leading to undesirable contamination of the pourer closure 1 in use. In addition, the retainer arrangement is optimally placed in the region of the run-up protuberances from the point of view of mechanical function, since separating forces which act in the same plane take care of simple opening. In this connection, the depression 22 and the beading 21 run concentrically around the outside of the run-up protuberance 16 and on the inside of the jacket portion 8, and ensure that engagement will take place whatever their relative attitude when placed in position. Alternatively, it would also be possible to provide the lower inner edge of the jacket portion 8 and the guide ring 19 with a corresponding depression and complementary beading in order to secure the pourer closure 1. Such a snap-action closure would have the advantage of requiring no additional material whatever for the arrangement, and that the retaining means would lie substantially in the plane of the run-up protuberance, thus simplifying the opening operation.

We claim:

1. In a two-piece pourer closure for a container comprising a base portion of elastic material to fit onto the container aperture and leave free a throughflow aperture, and a cover portion which closes the base portion, said base portion having a foot portion which is capable of being linked to the container aperture, a substantially cylindrical pouring cylinder surrounding the throughflow aperture, and a circular annular edge portion surrounding the lower end of the pouring cylinder, said cover portion having a sealing portion which projects from the bottom of the cover and which cooperates with the pouring cylinder, and an external jacket portion concentrically surrounding the pouring cylinder with an intermediate space therebetween, at least two cooperating run-up protuberances in the said intermediate space, at least one of which has a sloping plane surface, one protuberance being arranged on the base portion and one on the cover portion, whereby the cover portion on rotation in relation to the foot portion is lifted by the run-up protuberances, and the closure can be opened, the improvement comprising a guarantee ring projecting upwards and at least partly covering the jacket portion sufficiently to prevent the cover portion from being manually grasped and rotated, said guarantee ring being separably joined to the foot portion in the region of the circular annular edge portion by an intended tearing line comprising weakened places in the material, and means on the base portion centering and supporting at least the lower part of the jacket portion adjacent said tearing line against laterally acting forces.

2. A pourer closure as defined in claim 1, wherein said means for laterally supporting said jacket portion comprises a lateral surface of the run-up protuberance on said base portion.

3. A pourer closure as defined in claim 2, wherein plural run-up protuberances on said base portion are arranged near the internal wall of the jacket portion to centralise the jacket portion in relation to the base portion and to support it against lateral displacement.

4. A pourer closure as defined in claim 1, wherein said lateral support means comprises guide means on the circular annular edge portion arranged in a ring concentric with the pouring cylinder and abutting the internal wall of the jacket portion and inwardly supporting said internal wall.

5. A pourer closure as defined in claim 4, wherein said guide means comprise a continuous guide ring.

6. A pourer closure as defined in claim 1, wherein said means for supporting said jacket portion comprises complementary means on said base portion and said cover portion adapted to be brought into interfitting engagement to retain the cover portion against forces acting in a direction to separate said cover portion from said base portion.

7. A pourer closure as defined in claim 1, wherein said guarantee ring projects upwardly sufficiently to cover the major portion of said jacket portion.

8. In a two-piece pourer closure for a container comprising a base portion of elastic material to fit onto the container aperture and leave free a through flow aperture, and a cover portion which closes the base portion, said base portion having a foot portion which is capable of being linked to the container aperture, a substantially cylindrical pouring cylinder surrounding the through flow aperture, and a circular annular edge portion surrounding the lower end of the pouring cylinder, said cover portion having a sealing portion which projects from the bottom of the cover and which cooperates with the pouring cylinder, and an external jacket portion concentrically surrounding the pouring cylinder with an intermediate space therebetween, at least two cooperating run-up protuberances in the said intermediate space, at least one of which has a sloping plane surface, one protuberance being arranged on the base portion and one on the cover portion, whereby the cover portion on rotation in relation to the foot portion is lifted by the run-up protuberances, and the closure can be opened, the improvement comprising a guarantee ring projecting upwardly and at least partly covering the jacket portion to prevent the cover portion from being grasped and rotated, said guarantee ring being separably joined to the foot portion in the region of the circular annular edge portion by an intended tearing line comprising weakened places in the material, means on the base portion centering and supporting the jacket portion against laterally acting forces, and tooth like projections provided on the lower outer edge of said jacket portion extending into weakened places in the intended tearing line connecting said guarantee ring and said foot portion.

* * * * *